US009634379B2

(12) United States Patent
Kang

(10) Patent No.: US 9,634,379 B2
(45) Date of Patent: Apr. 25, 2017

(54) RADIATION DEVICE FOR PLANAR INVERTED-F ANTENNA AND ANTENNA USING THE SAME

(71) Applicant: LG INNOTEK CO., LTD., Seoul (KR)

(72) Inventor: Jin Ho Kang, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 298 days.

(21) Appl. No.: 13/662,608

(22) Filed: Oct. 29, 2012

(65) Prior Publication Data

US 2013/0106660 A1 May 2, 2013

(30) Foreign Application Priority Data

Oct. 28, 2011 (KR) ..... 10-2011-0110925

(51) Int. Cl.
*H01Q 1/24* (2006.01)
*H01Q 9/04* (2006.01)
*H01Q 5/371* (2015.01)

(52) U.S. Cl.
CPC ..... *H01Q 1/243* (2013.01); *H01Q 5/371* (2015.01); *H01Q 9/0414* (2013.01)

(58) Field of Classification Search
CPC ..... H01Q 1/243
USPC ..... 343/700 MS, 702
See application file for complete search history.

(56) References Cited

U.S. PATENT DOCUMENTS 6,795,028 B2 * 9/2004 Stutzman et al. ..... 343/702
6,836,252 B2 * 12/2004 Tai ..... H01Q 1/243 343/700 MS
6,985,114 B2 * 1/2006 Egashira ..... G06F 1/1616 29/600
7,298,334 B2 * 11/2007 Fang et al. ..... 343/700 MS
7,352,329 B2 * 4/2008 Chung ..... H01Q 1/243 343/700 MS
7,474,267 B2 * 1/2009 Chen et al. ..... 343/702
2006/0262016 A1 * 11/2006 Hung ..... H01Q 9/42 343/702

FOREIGN PATENT DOCUMENTS

KR 10-2005-0001488 A 1/2005
KR 10-2010-0095910 A 9/2010

* cited by examiner

*Primary Examiner* — Dameon E Levi
*Assistant Examiner* — Walter Davis
(74) *Attorney, Agent, or Firm* — Birch, Stewart, Kolasch & Birch, LLP

(57) ABSTRACT

A planar inverted-F antenna according to an embodiment includes a ground plane, a radiator spaced apart from the ground plane, and a feeding member for feeding a current to the radiator. A first slot is formed in the radiator, and the first slot is excited as the current is fed to the radiator through the feeding member such that the current flows around the first slot and the first slot implements a resonance frequency according to the excitation.

12 Claims, 3 Drawing Sheets

RADIATION DEVICE FOR PLANAR INVERTED-F ANTENNA AND ANTENNA USING THE SAME

BACKGROUND

The embodiment relates to a radiation device for a planar inverted-F antenna and an antenna using the same. In more particular, the embodiment relates to a radiation device for a planar inverted-F antenna which may be embedded inside a mobile communication device and an antenna using the same.

An inverted-F antenna may be utilized in various communication systems such as a mobile communication system, a UWB (Ultra-wide Band) wireless communication system, a WLAN (Wireless Local Area Network) system, a WiBro (Wireless Broadband) system, etc. Specifically, the inverted-F antenna is used as an embedded antenna for a mobile communication terminal.

Because an entire shape of the inverted-F antenna resembles an inverted 'F', this antenna is named as "inverted-F antenna". As compared with any other antennas, the size of the inverted-F antenna may be relatively small. The inverted-F antenna has an omni-directional radiation pattern, a relatively high gain and a wide bandwidth. Further, since the SAR (Specific Absorption Rate) of the inverted-F antenna is lower than that of any other external antennas, the inverted-F antenna is widely used for a mobile communication terminal.

FIG. 1 is a perspective view showing a general inverted-F antenna 100 of the related art. In general, the inverted-F 100 antenna includes a ground plane 150, a first radiator 101, a feeding member 102 and a shorting member 104. Because the entire shape of the inverted-F antenna including the first radiator 101, the feeding member 102 and the shorting member 104 resembles an inverted 'F', this antenna takes the name "inverted-F antenna". Although the inverted-F antenna has the merit of being embedded in a mobile communication terminal, the inverted-F antenna is limited in a space within the mobile communication terminal and a frequency bandwidth of the inverted-F antenna is limited.

SUMMARY

An embodiment provides an antenna representing superior characteristics under household electronic environment requiring the antenna when it is installed in an apparatus, such as a large-size household electronic appliance having a reflector of a complex structure and a large ground, thereby optimizing the performance of a MIMO system.

A planar inverted-F antenna according to an embodiment includes a ground plane; a radiator spaced apart from the ground plane; and a feeding member for feeding a current to the radiator, wherein a first slot is formed in the radiator, and the first slot is excited as the current is fed to the radiator through the feeding member such that the current flows around the first slot and the first slot implements a resonance frequency according to the excitation.

According to the embodiments, the planar inverted-F antenna may be implemented to be operated in a plurality of frequency bands and allow an antenna system using the same to be fabricated in a small size. Thus, the planar inverted-F antenna can be applied to various types of small portable terminals to transmit and receive signals through a multiple frequency bands.

DETAILED DESCRIPTION OF THE EMBODIMENTS

Figure 1:
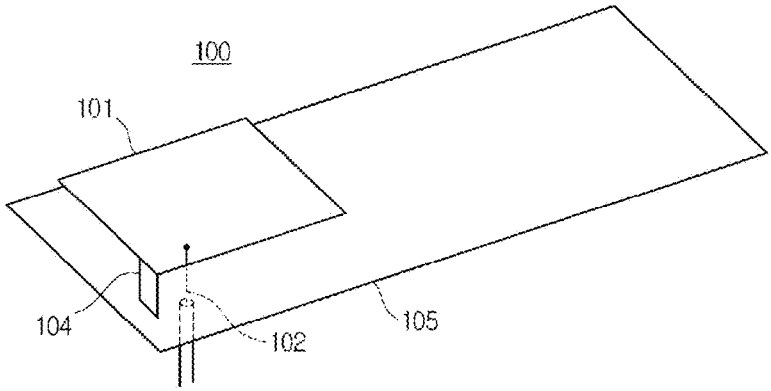
FIG. 1 is a perspective view showing a general inverted-F antenna of the related art.

Hereinafter, an exemplary embodiment of the disclosure will be described in detail with reference to accompanying drawings. Details of the embodiment will be included in the following description and the drawings. Advantages and characteristics of the embodiment, and a method for achieving them will be obvious if referring to the embodiment described in detail together with the accompanying drawings. In the following description, the same elements will be assigned with the same reference numerals for the purpose of obvious comprehension of the disclosure.

Figure 2:
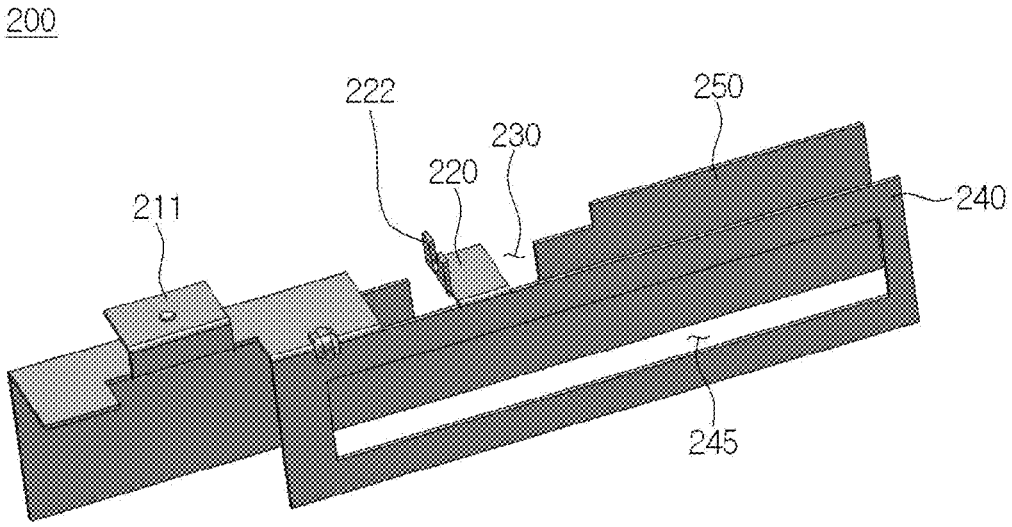
FIG. 2 is a perspective view showing a planar inverted-F antenna according to an embodiment.
Figure 3:
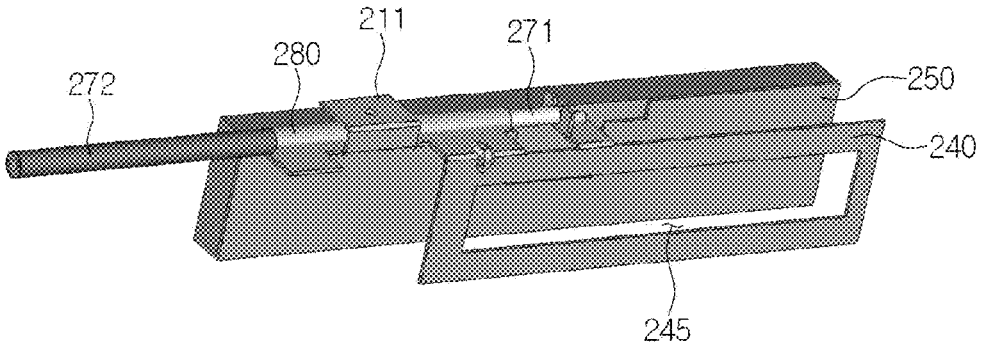
FIG. 3 is a perspective view showing a planar inverted-F antenna having a power supplying part according to an embodiment.

FIG. 2 is a perspective view showing a planar inverted-F antenna according to an embodiment, and FIG. 3 is a perspective view showing a planar inverted-F antenna having a power supplying part according to an embodiment.

The planar inverted-F antenna 200 according to the embodiment includes a ground plane 250, a first radiator 240 in which a first slot 245 is formed, a feeding member 220 and a shorting member 211.

The ground plane 250 is formed of a copper plate on a PCB (Printed Circuit Board). The ground plane 250 may include a second slot 230 having one side closed and the other side opened.

The first radiator 240 is made of a metallic material. The first radiator 240 generates a predetermined radiation pattern, such that the first radiator 240 transmits an RF signal to an outside or receives an RF signal from the outside. As shown in FIG. 2, the first radiator 240 is spaced apart from the ground plane 250 and is mainly designed in a plate shape. The first radiator 240 does not necessarily have a rectangular plate shape, but may have various shapes such as a rectangular plate shape with cut corners, an elliptical plate shape, a bending plate shape, etc. The first slot 245 may be formed in the first radiator 240 to ensure a frequency bandwidth. Although the first slot 245 is formed in a rectangular shape, the embodiment is not limited thereto. In detail, the shape and the size of the first slot 245 may be modified in various shapes such as alphabets "Y", "T", "X" and "M", and may have sizes in match with a characteristic of a resonance frequency.

The feeding member 220, which is a path for supplying electric power, receives power from a power supplying part 280 and provides the power to the first radiator 240. As shown in FIG. 2, the feeding member 220 may be formed in a type of a feed line or a feed pin. The shorting member 211 connects the ground plane 250 with the first radiator 240 such that they are shorted to each other. As shown in the drawing, the shorting member 211 may be formed in a plate shape or a short pin shape.

The inverted-F antenna 200 operates as follows. First, a current is provided to the first radiator 240 through the feeding member 220. The current circulates through the first radiator 240 and then is provided to the ground plane 250 through the shorting member 211. In this manner, a current circulating path is formed in the inverted-F antenna 200, so that an electromagnetic wave is radiated into air. In a case that the inverted-F antenna 200 receives an electromagnetic wave, the first radiator 240 is excited by the electromagnetic wave, so that a current circulating path is formed. Thus, the inverted-F antenna 200 can receive the electromagnetic wave.

As shown in FIG. 2, a coupling part 222 may be formed at the feeding member 220 to fix the power supplying part 280. The coupling part 222 may be formed in a circle shape.

As shown in FIG. 3, the power supplying part 280 may be implemented with a coaxial probe for impedance matching. The power supplying part 280 may include an inner sheath 271 and an outer sheath 272, and the inner sheath 271 may be an insulator.

Figure 4:
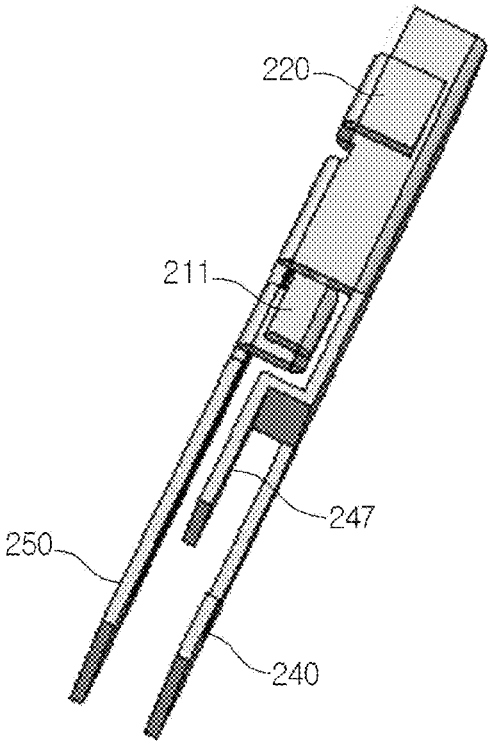
FIG. 4 is a perspective view showing a planar inverted-F antenna according to another embodiment.

FIG. 4 is a perspective view showing a planar inverted-F antenna according to another embodiment. The ground plane 250 may be formed of a conductive conductor such as a copper plate formed on a circuit substrate. Although the shape of the ground plane 250 is not limited, the ground plane 250 may be designed in a wide rectangular plate shape. The first and second radiators 240 and 247 are made of a conductive conductor. As shown in FIG. 4, the first radiator 240 is spaced apart from the ground plane 250 and the second radiator 247 is disposed between the ground plane 250 and the first radiator 240 such that the second radiator 247 is spaced apart from the ground plane 250 and the first radiator 240.

The second radiator 247 may be formed by bending a portion of the first radiator 240. The first and second radiators 240 and 247 may be formed in an integrated metal pattern.

The feeding member 220 provides a current to the first radiator 240. The shorting member 211 connects the first radiator 240 with the ground plane 250 such that they are shorted to each other. The second radiator 247 is placed between the ground plane 250 and the first radiator 240.

Although there is no limitation in types of the first and second radiators 240 and 247, the first and second radiators 240 and 247 may be designed in a rectangular plate shape. At least one of the first and second radiators 240 and 247 may be formed in a plate shape having a slot. In addition, the first and second radiators 240 and 247 may have various shapes such as a rectangular plate shape with cut corners, an elliptical plate shape, a bending plate shape, etc.

The first and second radiators 240 and 247 may be disposed in parallel to the ground plane 250, respectively. Lengths, widths, thicknesses or intervals from the ground plane 250 of the first and second radiators 240 and 247 may vary depending on a frequency bandwidth of the inverted-F antenna 200.

Because the second radiator 247 is placed in a downward direction of the first radiator 240, the second radiator 247 may be easily modified and designed in a different type according to desired frequency characteristics. Insulators disposed between the ground plane 250 and the first radiator 240, between the ground plane 250 and the second radiator 247, and between the first radiator 240 and the second radiator 247 may be different from each other.

The first radiator 240 receives a current through the feeding member 220, and the current circulates through the first radiator 240. In this case, the second radiator 247 is connected to the ground plane 250, so that a current path may be formed through the second radiator 247. A part of the current, which is transferred to the first radiator 240 through electromagnetic coupling between the second radiator 247 and the first radiator 240, is transferred to the second radiator 247 and flows into the ground plane 250. The remaining part of the current may flow through the first radiator 240 into the ground plane 250. These current paths may be ¼ length based on a wavelength of the radiated electromagnetic wave.

In addition, the electromagnetic coupling may occur between the first and second radiators 240 and 247 even when the inverted-F antenna 200, in which the second radiator 247 is formed, receives the electromagnetic wave.

Thus, the current path may be longer than the case employing only the first radiator 240. That is, in the inverted-F antenna 200 including the second radiator 247, the current path inside the antenna is longer due to the electromagnetic coupling. The current path has ¼ length based on the electromagnetic wave having a resonance frequency of the antenna, and since the wavelength and frequency of the electromagnetic wave are inversely proportional to each other, the operation frequency of the antenna may be more lowered.

The inverted-F antenna 200 according to the embodiment may vary the operating frequency bandwidth of the antenna 200 by using the second radiator 247. Further, since the second radiator 247 is placed between the first radiator 240 and the ground plane 250, when the operation frequency is changed, the size of the antenna 200 is not changed and the feeding scheme of the electromagnetic coupling is utilized, so the antenna 200 may have a smaller size than that of an antenna of the related art under the same frequency condition. Thus, the antenna 200 may represent a high performance in a limited space and may be suitable for an embedded antenna.

When the second radiator 247 radiates an electromagnetic wave together with the first radiator 240, since the current path formed in the antenna 200 is longer, the antenna 200 resonates at a lower frequency.

Figure 5:
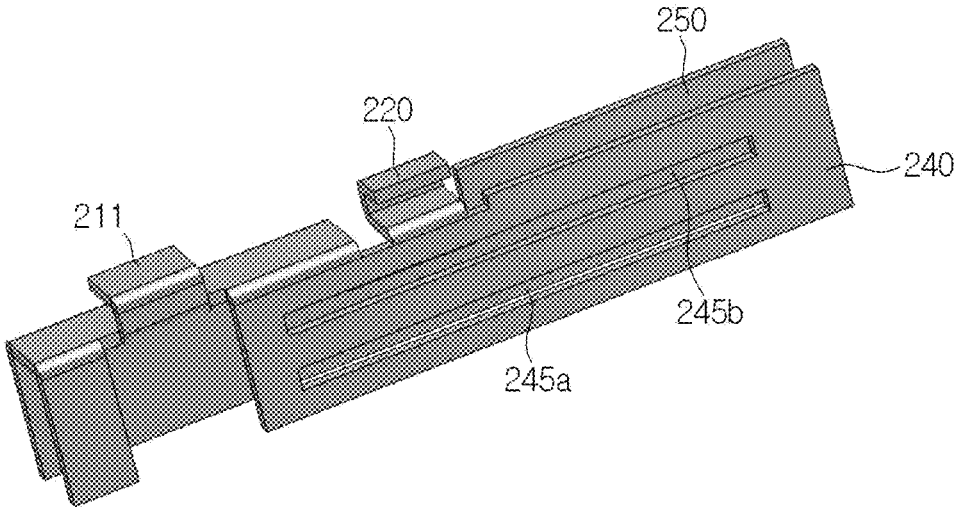
FIG. 5 is a perspective view showing a planar inverted-F antenna according to still another embodiment.

FIG. 5 is a perspective view showing a planar inverted-F antenna according to still another embodiment. The following description will be made while focusing on differences with respect to the embodiment depicted in FIG. 2. Plural first slots may be formed in the first radiator 240. In detail, a first-a slot 245*a* and a first-b slot 245*b* may be formed. The first-a slot 245*a* and the first-b slot 245*b* may be formed in the same shape, or may be formed in different shapes and sizes from each other. The frequency bandwidth characteristic of the inverted-F antenna may vary by the first-a slot 245*a* and the first-b slot 245*b*.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A planar inverted-F antenna comprising:

a ground plane;

a first radiator spaced apart from the ground plane and disposed to face and be opposite to a first surface of the ground plane;

a feeding member connected to the first radiator for feeding a current to the first radiator;

a shorting member formed by bending a portion of the ground plane and for shorting the ground plane and the first radiator to each other; and a second radiator formed by bending a portion of the first radiator and disposed to face and be opposite to the first surface of the ground plane and in parallel to the ground plane and disposed between the ground plane and the first radiator while being spaced apart from the ground plane and the first radiator and having a plate shape, wherein at least one of the first radiator or the second radiator is formed in a plate shape having a first slot for varying a frequency bandwidth characteristic of the antenna, wherein the second radiator is placed in a downward direction of the first radiator, and wherein the feeding member forms a coupling part for fixing a power supply part.

2. The planar inverted-F antenna of claim 1, wherein the first slots are placed in the radiator at a position corresponding to a top end of the ground plane and have a rectangular shape.

3. The planar inverted-F antenna of claim 1, wherein the power supply part includes a coaxial probe.

4. The planar inverted-F antenna of claim 1, wherein the ground plane includes a second slot and one side of the second slot is closed and an opposite side of the second slot is open.

5. The planar inverted-F antenna of claim 1, wherein the second radiator receives energy through an electromagnetic coupling with the first radiator.

6. The planar inverted-F antenna of claim 1, wherein the first and second radiators are formed as an integrated metal pattern.

7. A mobile communication terminal comprising:

a planar inverted-F antenna, wherein the planar inverted-F antenna comprises:

a ground plane;

a first radiator spaced apart from the ground plane and disposed to face and be opposite to a first surface of the ground plane;

a feeding member connected to the first radiator for feeding a current to the first radiator;

a shorting member formed by bending a portion of the ground plane and for shorting the ground plane and the first radiator to each other; and a second radiator formed by bending a portion of the first radiator and disposed to face and be opposite to the first surface of the ground plane and disposed between the ground plane and the first radiator while being spaced apart from the ground plane and the first radiator and having a plate shape, wherein the first radiator includes a plurality of first slots for varying a frequency bandwidth characteristic of the antenna, wherein the second radiator is placed in a downward direction of the first radiator, and wherein the feeding member forms a coupling part for fixing a power supply part.

8. The mobile communication terminal of claim 7, wherein the first slots are placed in the radiator at a position corresponding to a top end of the ground plane and have a rectangular shape.

9. The mobile communication terminal of claim 7, wherein the power supply part includes a coaxial probe.

10. The mobile communication terminal of claim 7, wherein the ground plane includes a second slot and one side of the second slot is closed and an opposite of the second slot is open.

11. The planar inverted-F antenna of claim 1, wherein the feeding member is only connected to the first radiator.

12. The mobile communication terminal of claim 7, wherein the feeding member is only connected to the first radiator.

* * * * *